US011065621B2

(12) United States Patent
Brettschneider et al.

(10) Patent No.: US 11,065,621 B2
(45) Date of Patent: Jul. 20, 2021

(54) MICROFLUIDIC DEVICE, PRODUCTION METHOD, AND METHOD FOR OPERATING A MICROFLUIDIC DEVICE

(71) Applicant: Robert Bosch GmbH, Stuttgart (DE)

(72) Inventors: Thomas Brettschneider, Leonberg (DE); Jochen Rupp, Stuttgart (DE); Daniel Czurratis, Korntal-Muenchingen (DE); Christian Dorrer, Winnenden (DE); Karsten Seidl, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 615 days.

(21) Appl. No.: 16/065,590

(22) PCT Filed: Dec. 6, 2016

(86) PCT No.: PCT/EP2016/079866
§ 371 (c)(1),
(2) Date: Jun. 22, 2018

(87) PCT Pub. No.: WO2017/108387
PCT Pub. Date: Jun. 29, 2017

(65) Prior Publication Data

US 2021/0162403 A1 Jun. 3, 2021

(30) Foreign Application Priority Data

Dec. 22, 2015 (DE) ..... 10 2015 226 417.3

(51) Int. Cl.
*B01L 3/00* (2006.01)

(52) U.S. Cl.
CPC ..... *B01L 3/50273* (2013.01); *B01L 3/502723* (2013.01); *B01L 2200/0684* (2013.01);
(Continued)

(58) Field of Classification Search
CPC ..... B01L 3/50273; B01L 3/502723; B01L 2300/044; B01L 2200/12;
(Continued)

(56) References Cited

U.S. PATENT DOCUMENTS

2006/0275852 A1 12/2006 Montagu et al.
2007/0224084 A1 9/2007 Holmes et al.
(Continued)

FOREIGN PATENT DOCUMENTS

DE 10 2010 001 412 A1 8/2011
DE 10 2012 212 650 A1 1/2014
(Continued)

OTHER PUBLICATIONS

International Search Report corresponding to PCT Application No. PCT/EP2016/079866, dated Feb. 7, 2017 (German and English language document) (5 pages).

*Primary Examiner* — Jennifer Wecker
*Assistant Examiner* — Jonathan Bortoli
(74) *Attorney, Agent, or Firm* — Maginot, Moore & Beck LLP

(57) ABSTRACT

A microfluidic device includes a chamber substrate, a cover substrate, a flexible membrane, and a punch unit. The chamber substrate includes a fluid chamber configured to receive a fluid and having a fluid chamber opening. The cover substrate includes a punch opening lying opposite the fluid chamber opening. The flexible membrane is positioned between the chamber substrate and the cover substrate, and spans the punch opening and the fluid chamber opening. The punch unit is configured to move into the fluid chamber through the punch opening in order to deflect the flexible membrane into the fluid chamber so as to enable the fluid to flow out of the fluid chamber when fluid is received in the fluid chamber.

18 Claims, 9 Drawing Sheets

(52) U.S. Cl.
CPC ..... *B01L 2200/12* (2013.01); *B01L 2200/16* (2013.01); *B01L 2300/044* (2013.01); *B01L 2300/0672* (2013.01); *B01L 2300/123* (2013.01)

(58) Field of Classification Search
CPC ..... B01L 2200/0684; B01L 2200/16; B01L 2300/0672; B01L 2300/123
See application file for complete search history.

(56) References Cited

U.S. PATENT DOCUMENTS

| | | | |
|---|---|---|---|
| 2011/0086433 | A1 | 4/2011 | Rupp |
| 2011/0186466 | A1 | 8/2011 | Kurowski et al. |

FOREIGN PATENT DOCUMENTS

| | | | |
|---|---|---|---|
| DE | 10 2012 222 719 | A1 | 6/2014 |
| EP | 2 687 290 | A1 | 1/2014 |
| EP | 2 905 079 | A1 | 8/2015 |
| WO | 2009/152952 | A1 | 12/2009 |
| WO | 2014/090610 | A1 | 6/2014 |

MICROFLUIDIC DEVICE, PRODUCTION METHOD, AND METHOD FOR OPERATING A MICROFLUIDIC DEVICE

This application is a 35 U.S.C. § 371 National Stage Application of PCT/EP2016/079866, filed on Dec. 6, 2016, which claims the benefit of priority to Serial No. DE 10 2015 226 417.3, filed on Dec. 22, 2015 in Germany, the disclosures of which are incorporated herein by reference in their entirety.

BACKGROUND

The disclosure relates to a microfluidic device and method of producing and using the same.

In microfluidic devices, liquids are supplied, or transported, on a chip. Such microfluidic devices can be used for example in so-called lab-on-a-chip systems (LOCs), in which the entire functionality of a macroscopic laboratory is accommodated on a plastic substrate (LOC cartridge) which is for example the size of a credit card, and complex biological, diagnostic, chemical or physical processes can take place in a miniaturized form. Many LOC systems require a selection of fluids, such as liquid reagents, such as for example saline solutions, ethanol-containing solutions, aqueous solutions, detergents or dry reagents, such as lyophilizates, salts, etc., which are required for a wide range of different diagnostic applications. Said reagents can firstly be manually pipetted onto the LOC cartridge, or can be pre-stored already on the cartridge. The latter yields advantages with regard to automation, contamination risks, user-friendliness and transportability of LOC systems.

WO 2014/090610 A1 describes a design in which liquids are stored in tubular bags, so-called stick packs. The stick packs are integrated into the LOC system in which they can, in a pressure-driven manner, be opened via deflection of a flexible diaphragm and be emptied.

SUMMARY

Against this background, the approach that is set out here presents a microfluidic device, a method for producing a microfluidic device and a method for operating a microfluidic device in accordance with the main claims. As a result of the measures stated in the dependent claims, advantageous refinements and improvements of the microfluidic device specified in the independent claim are possible.

One advantage of the microfluidic device described is that, for LOC applications, it is possible for liquids, such as reagents and moisture-sensitive dry reagents, to be stored in a long-term stable state and to be supplied, as necessary, via a mechanical element, such as for example a punch, a punch unit or a ram.

A microfluidic device having the following features is presented:

a chamber substrate with a fluid chamber for accommodating a fluid;

a cover substrate with a punch opening, wherein the punch opening is arranged opposite a fluid chamber opening of the fluid chamber;

a flexible diaphragm which is arranged between the chamber substrate and the cover substrate and spans the punch opening and the fluid chamber opening; and a punch unit which is designed to move into the fluid chamber through the punch opening in order to deflect the diaphragm into the fluid chamber in order to allow the fluid to flow out of the fluid chamber when the fluid is accommodated in the fluid chamber.

The chamber substrate and the cover substrate can be a polymer substrate composed of plastics with good barrier properties. The diaphragm is designed to be deflected when a pressure is applied to the diaphragm. According to an embodiment, the diaphragm is formed to be highly flexible and tear-resistant. According to an embodiment, the diaphragm is designed to retract to its original position when the pressure is released. It is also possible, in particular in the case of a large deflection of the diaphragm, for plastic deformation to occur, this however not necessarily obstructing the function.

A presented mechanical punch unit of the microfluidic device allows a reliable release of reagents. Since a large force can be safely applied to the fluid chamber, holding for example a fluid, it is possible for the fluid to be stored for example in a blister or behind a barrier film with a particularly strong layer structure, which allows the fluid to be stored safely and in a long-term stable manner. The diaphragm presented offers the advantage that the punch unit can remain separated from the fluid at all times and is thus reusable owing to the hygienic possibility of use. This can create a cost advantage. The fluid chamber can have for example a volume of less than 30 ml, 20 ml, 10 ml, 5 ml or 1 ml, or less than 0.1 ml. Moreover, a mechanically movable punch unit offers the advantage that the release of the reagents does not necessarily have to be gravity-driven. The punch unit can displace the reagent volume into other chambers or channels via the diaphragm, wherein the entire structure can be oriented in any desired manner, for example at a 0° inclination but also at a, for example, 30°, 45° or 60° inclination. This offers advantages during handling and during the processing of the LOC cartridges.

The fluid can be accommodated in the fluid chamber and kept in the fluid chamber by a barrier film which closes off the fluid chamber. In this case, the barrier film can be formed to be opened by the punch unit in order, for example, to fluidically connect a channel or a transfer chamber to the fluid chamber. Such a barrier film allows the fluid, such as for example a reagent, to be pre-stored safely in the fluid chamber and to be released in a targeted manner by the insertion of the punch unit into the barrier film only as necessary.

According to an embodiment, the fluid can be arranged in an insert container which is accommodated by the fluid chamber, wherein the barrier film closes off the insert container. Such an insert has the advantage that direct filling of the fluid chamber can be avoided, and thus production can be simplified, use can be simplified and erroneous operation and the risk of contamination can be ruled out. According to different embodiments, the insert container can be of flexible or plastic form.

The insert can be formed such that it is able to be accommodated in the fluid chamber with an accurate fit, the material of the insert in this case being able to have a better barrier property with respect to the fluid than the chamber substrate. It is thus possible for different fluids having different requirements for pre-storage in a long-term stable state to be safely stored in the device in inserts which are formed specifically for the requirements of the fluids. A material selection of the chamber substrate can thus be realized independently of pre-storage materials suitable for fluids.

The fluid can also be arranged in a blister which is accommodated by the fluid chamber, wherein the blister substantially fills a volume of the fluid chamber, wherein the blister is formed to be opened by the punch unit. A blister can be formed for example from one or more sealing films, whose edges can be connected by leak-tight sealing seams, and provide a low-cost alternative to an insert. A blister composed of an elastic material can for example be accommodated, for example adhesively bonded, in fluid chambers of different form in a simple manner.

It is an advantage if, according to an embodiment, a diameter of the punch opening is greater than half the diameter of the fluid chamber opening. The diameter of the punch opening can advantageously have a diameter which corresponds to the diameter of the fluid chamber opening. This allows the volume of the fluid chamber can almost completely displace. A punch tip of the punch unit can in this case advantageously be formed such that the fluid in the fluid chamber is displaced in the direction of a channel.

In further advantageous embodiments, the punch unit can adopt geometries on the end face, which promote tearing of the barrier film in the direction of the transfer chamber without damaging the flexible diaphragm. Of particular advantage here are punch geometries which have raised portions on the end face of the punch unit in order, by way of local pressure peaks, to promote the start of the tearing of the barrier film exactly in this region. When the punch unit is dipped further, the tearing continues and the displacement of the reagents acquires a corresponding preferential direction. This allows controlled displacement of the reagents into the transfer chamber.

A simple method is to allow the punch to move at a defined feed speed (typically 1 mm/min to 50 mm/min) until the end face of the punch unit makes contact with the base of the fluid chamber. It furthermore proves to be advantageous to configure the movement of the punch in step form. In the first step, the punch unit moves until the first tear in the barrier film. In the second step, the punch unit moves a few millimeters back in order to allow the reagent to escape through the resulting cracks. In the third step, the punch unit moves up to the base of the fluid chamber for complete displacement of the liquid into the transfer chamber. Here, any desired further variations in the feed speed and the sequence of the direction of movement of the punch unit are conceivable in order to allow an optimum and efficient release of reagents into the transfer chamber.

The device can have a channel which extends on a side of the diaphragm facing the chamber substrate and which is fluidically connected to the fluid chamber. The channel can open into the fluid chamber. It is possible to arrange, at an end of the channel opposing the fluid chamber, a transfer chamber for safely collecting the fluid. In the transfer chamber, it is possible for example for a further fluid to also be pre-stored, which can be designated for mixing with the fluid after the release of the fluid. Alternatively, such a transfer chamber can also open directly into the fluid chamber.

The diameter of the punch opening can be less than half the diameter of the fluid chamber opening. In this case, the punch opening can be arranged adjacent to the channel. A relatively small punch opening can receive a correspondingly small punch unit, which in turn can make space available for, for example, a further punch opening and/or for a venting opening on the side of the fluid chamber opening. Advantageously, at a particular inclination angle of the device, the channel can be arranged such that the fluid can flow away or be extracted in a gravity-directed direction. If the punch opening is, as presented, arranged adjacent to the channel, the venting opening can be arranged for example above the punch opening, from where, for example, an inflow of ambient air through the venting opening can promote the flowing-away of the fluid.

The channel can have a channel extension, and the cover substrate can have a venting opening which opens into the channel extension, wherein the punch opening can be arranged between the venting opening and the channel, wherein the diaphragm does not span the venting opening.

A presented venting opening above the channel having a connection to the channel can, for example by way of a resulting connection with respect to the ambient air, promote flowing-away of the fluid through the channel.

The cover substrate can have a venting opening which opens into the fluid chamber, wherein the punch opening can be arranged between the venting opening and the channel, wherein the diaphragm can span the venting opening. Moreover, the device can have a further punch unit which is designed to move into the fluid chamber through the venting opening in order to deflect the diaphragm into the fluid chamber in order to allow a further fluid to flow into the fluid chamber.

A presented approach allows the opening of a fluid chamber, which is closed off for example by the barrier film, and/or the opening of a blister, which is arranged in the fluid chamber, at two different positions. Also, the approach provides the basic prerequisite for a possibly additional air channel having a connection to the venting opening and to the fluid chamber and which can allow a further fluid to flow into the fluid chamber.

It is advantageous if, according to an embodiment, between the chamber substrate and the diaphragm, there is arranged an intermediate substrate which has a further punch opening, extending the punch opening, and has a further venting opening, extending the venting opening, and which is formed to create an air channel extending transversely with respect to the venting opening and opening into the further venting opening.

The air channel can extend in a direction facing away from the channel. A presented air channel can, by way of an inflow of, for example, ambient air into the fluid chamber through the air channel, compensate for a generated negative pressure in the fluid chamber after the punching process and while the fluid is flowing away, and thus promote the flowing-away of the fluid through the channel. Moreover, the intermediate substrate prevents an air path for venting forming during the active suctioning of the released fluid. Otherwise, there is a risk that, instead of liquid, only air is suctioned.

The channel can extend between the diaphragm and the intermediate substrate and open into the punch opening. This approach allows a favorable arrangement of the channel if an intermediate substrate is arranged in the device.

A diameter of the fluid chamber opening can correspond to the punch opening, wherein the fluid chamber has a second punch opening which corresponds to a diameter of the further venting opening. The chamber substrate can thus extend, apart from in the region of the fluid chamber opening and in the region of the second fluid chamber opening, over a fluid chamber opening side on which the fluid chamber opening and the second fluid chamber opening are arranged. The chamber substrate can thus be of more stable form. According to this embodiment, a barrier film for closing the fluid chamber, which is possibly arranged, can be for example adhesively bonded along an inner side of the fluid chamber facing the fluid chamber opening side and/or arranged between the chamber substrate and the intermediate substrate. If the barrier film is arranged between the chamber substrate and the intermediate substrate, the barrier film can span the fluid chamber opening and the second fluid chamber opening, and also the further venting opening and the further punch opening of the intermediate substrate.

A fluid chamber base opposite the fluid chamber opening can be formed by a further barrier film. As a result of the above-described higher stability of the chamber substrate on the fluid chamber opening side, the opposite fluid chamber base of the chamber substrate can be formed solely by the further barrier film. It is thus possible, for example, for the chamber substrate to be filled in advance from the side of the fluid chamber base and subsequently closed off by the further barrier film. Moreover, as a result of the at least slightly flexible further barrier film, it is possible during the punching process for an inner pressure, generated by the moving-in of the punch units, in the fluid chamber to be compensated by a slight movement of the further barrier film in the direction of the punch movement. In this further advantageous embodiment with additional barrier film, the formation of an air path during the active suctioning of the fluid is completely ruled out since the base of the fluidic chamber is connected over its full surface to the intermediate substrate.

A method for producing a microfluidic device comprises the following steps:

provision of a chamber substrate which has a fluid chamber for accommodating a fluid, provision of a cover substrate which has a punch opening which is arranged opposite a fluid chamber opening of the fluid chamber;

arrangement of a flexible diaphragm between the chamber substrate and the cover substrate, wherein the diaphragm spans the punch opening and the fluid chamber;

optional creation of a channel on a side of the diaphragm facing the chamber substrate, wherein the channel is fluidically connected to the fluid chamber; and provision of a punch unit which is designed to move into the fluid chamber through the punch opening in order to deflect the diaphragm into the fluid chamber in order to allow the fluid to flow out of the fluid chamber when the fluid is accommodated in the fluid chamber.

A method for operating one such microfluidic device comprises the following step:

moving-in of the punch unit into the fluid chamber through the punch opening in order to deflect the diaphragm into the fluid chamber in order to allow the fluid to flow out of the fluid chamber when the fluid is accommodated in the fluid chamber.

BRIEF DESCRIPTION OF THE DRAWINGS

Exemplary embodiments of the disclosure are illustrated in the drawings and described in more detail in the description below. In the drawings.

DETAILED DESCRIPTION

In the following description of favorable exemplary embodiments of the present disclosure, identical or similar reference signs are used for the elements which are illustrated in the various figures and act in a similar way, without the description of said elements being repeated.

Figure 1:
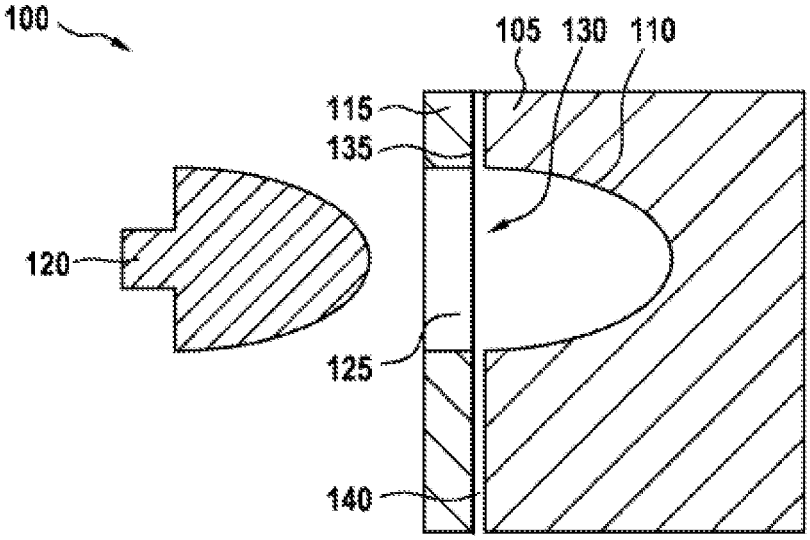
FIG. 1 shows a schematic cross-sectional illustration of a microfluidic device according to an exemplary embodiment.

FIG. 1 shows a schematic cross section of a microfluidic device 100 according to an exemplary embodiment. The device 100 comprises a chamber substrate 105 with a fluid chamber 110, and a cover substrate 115 which is arranged adjacent to the chamber substrate 105. The cover substrate 115 is arranged between the chamber substrate 105 and a punch unit 120. The cover substrate 115 has a punch opening 125, and the fluid chamber 110 has a fluid chamber opening 130. Arranged between the chamber substrate 105 and the cover substrate 115 is a flexible diaphragm 135 which spans the fluid chamber opening 130 and the adjacently arranged punch opening 125. A channel 140 which is fluidically connected to the fluid chamber 110 optionally extends on a side of the diaphragm 135 facing the chamber substrate 105.

In one variant, the channel 140 extends on a side of the cover substrate 115 facing the diaphragm 135. The channel is then fluidically connected to the fluid chamber 110 via a through-hole in the diaphragm 135. In said variant, the diameter of the punch opening 125 is advantageously less than the diameter of the fluid chamber opening 130, with the result that it is possible to route the channel 140 in the cover substrate 115 up to a position opposite the fluid chamber opening 130.

The punch unit 120 is formed to move into the fluid chamber 110 through the cover substrate 115. According to this exemplary embodiment, the punch unit 120 has, on a side facing the cover substrate 115, a rounded punch tip which corresponds to an inner geometry of the fluid chamber 110. When the punch unit 120 moves into the fluid chamber, the diaphragm 135 is deflected into the fluid chamber 110 by the rounded punch tip of the punch unit 120. When the punch unit 120 moves back out of the fluid chamber, according to an exemplary embodiment, the diaphragm 135 assumes its original position (which is illustrated in FIG. 1) again. Alternatively, the diaphragm 135 remains at least partially deformed after the punch unit 120 has moved back.

A fluid can for example be accommodated in the fluid chamber 110 in a blister. The fluid can also be introduced directly into the fluid chamber, wherein the fluid chamber opening 130 can then be closed off by a barrier film in order that the fluid is not able to flow into the channel 140. The fluid can alternatively be accommodated in an insert container which is accommodated in the fluid chamber 110, wherein the insert container can be closed off by the barrier film.

By way of example, the microfluidic device 100 in FIG. 1 is shown in a position with a 0° inclination.

Figure 2:
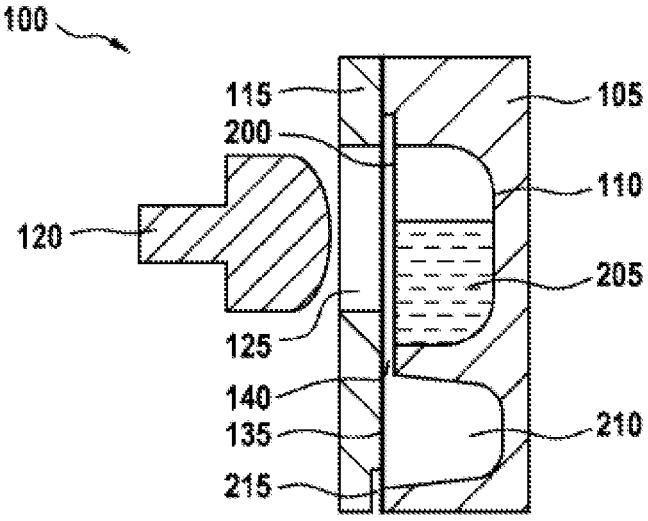
FIG. 2 shows a cross-sectional illustration of a microfluidic device according to an exemplary embodiment.

FIG. 2 shows a schematic cross section of a microfluidic device 100 according to an exemplary embodiment. Here, this can be the microfluidic device 100 described on the basis of FIG. 1, with the difference that the fluid chamber in FIG. 2 has the barrier film 200 and the fluid 205 which is arranged in the fluid chamber 110. Furthermore, the device 100 has a transfer chamber 210 with a valve 215. According to this exemplary embodiment, the fluid 205 is accommodated directly in the fluid chamber 110, with the barrier film 200 closing the fluid chamber opening, as a result of which the fluid 205 is kept safely in the fluid chamber 110. According to this exemplary embodiment, the fluid 205 does not completely fill the fluid chamber 110, and a further content, such as for example gas or air, can be arranged in the fluid chamber 110. According to an alternative exemplary embodiment, the fluid 205 can also be accommodated in a blister which is arranged in the fluid chamber 110.

According to this exemplary embodiment, the transfer chamber 210 is connected to the channel 140, with the channel 140 being arranged between the fluid chamber 110 and the transfer chamber 210. According to this exemplary embodiment, the transfer chamber 210 is arranged beneath the fluid chamber 205. The transfer chamber 210 has the valve 215 on a side facing away from the fluid chamber 110.

Details which have already been described will be stated more precisely below on the basis of FIG. 2:

The LOC system 100 in the form of the microfluidic device 100 can consist of polymer-based multilayer constructions in the form of the chamber substrate 105 and the cover substrate 115. The chamber substrate 105 and the cover substrate 115 comprise polymer-based substrates in which cavities in the form of the fluid chamber 205 and/or of the channel 140 are arranged. Storage of liquids 205 (hereinafter referred to merely as fluids 205) with small volumes of less than 1 ml is possible only to a limited extent in the fluid chamber 110 of the chamber substrate 105 since most plastics do not have adequate barrier properties for storage in a long-term stable state (PC, PA, PS, PMMA). Moreover, it is important that the fluid 205, such as for example a reagent, is closed off in the initial state, for example by normally closed valves 215, and can be supplied as necessary, this implying additional requirements for storage concepts. In order to store the fluid 205 in a long-term stable state, it is therefore possible according to this exemplary embodiment for a separate container, such as a blister pack or a tubular bag in the form of the blister, to be accommodated in the fluid chamber 110, as a result of which the chamber substrate 105 is not limited in terms of its material selection. This implies requirements for the production process owing to the handling and pick-and-place processes. The chamber substrate 105 is advantageously produced from plastics having good barrier properties, such as for example COP, COC, PP, PE or PET, which allows safe pre-storage of fluids or reagents in the chamber substrate 105. A design which is based on such plastics on the one hand can be integrated directly into the material system of the fluid chamber 110, or on the other hand can be fluidically connected to the fluid chamber 110 by a joining process by for example adhesive bonding, welding or clamping.

According to an exemplary embodiment, the illustrated device 100 has a polymer layer structure consisting of at least two polymer substrates, namely the chamber substrate 105 and the cover substrate 115, which are separated by the flexible diaphragm 135. A pre-stored fluid 205 is arranged in the chamber substrate 105, for example in the blister, in a sealed injection-molded insert container, or in a cutout, closed off by the, or by a plurality of the, barrier film(s) 200, in the form of the fluid chamber 110 within the chamber substrate 105. For the purpose of supplying the pre-stored fluid 205, use is made of at least one punch unit 120, for example a ram, which is able to penetrate through at least one opening in the form of the punch opening 125 in the cover substrate 115 by way of relative movement into the LOC in the form of the fluid chamber 110.

Figure 3:
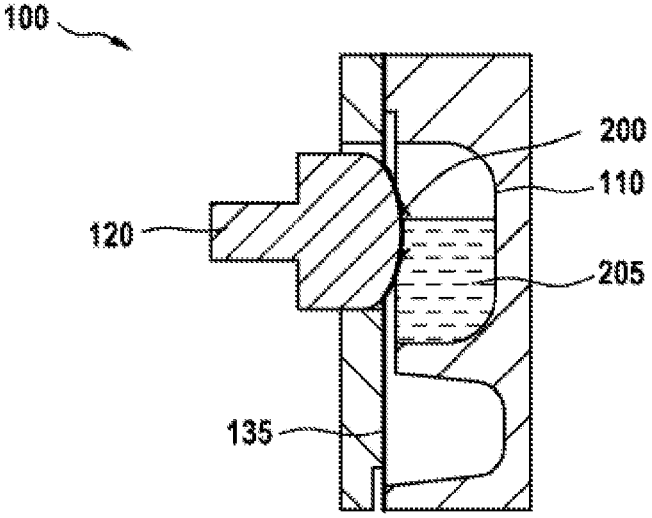
FIG. 3 shows a cross-sectional illustration of a microfluidic device according to an exemplary embodiment.

FIG. 3 shows a schematic cross section of a microfluidic device 100 according to an exemplary embodiment. Here, this can be the device 100 described on the basis of FIG. 2, with the difference that, according to this exemplary embodiment, the punch unit 120 has been inserted into the punch opening and the barrier film 200 has been opened by the punch unit 120.

Here, the flexible diaphragm 135 has been deflected by the punch unit 120 without tearing. Upon contact with the barrier film 200, a force is applied by the punch unit 120, which force leads to a sealing film of the blister, arranged for example in the fluid chamber 110, and/or the barrier film 135 being torn.

Figure 4:
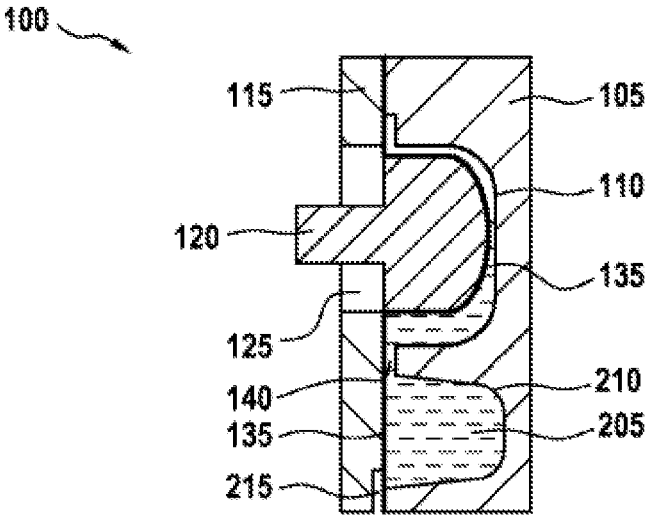
FIG. 4 shows a cross-sectional illustration of a microfluidic device according to an exemplary embodiment.

FIG. 4 shows a schematic cross section of a microfluidic device 100 according to an exemplary embodiment. Here, this can be the device 100 described on the basis of FIG. 3, with the difference that, according to this exemplary embodiment, the punch unit 120 has been completely inserted into the fluid chamber 110 and the fluid 205 has been displaced into the transfer chamber 210.

The fluid 205 has been either displaced into a supply chamber 210 (previously referred to as a transfer chamber 210) or emptied into the connected microfluidic channel 140 after the pulling back of the punch unit 120.

The approach which has been described results in the advantage of a reliable supply of the fluid 205 by way of the mechanically actuated punch unit 120 or the ram. Moreover, the introduction of defined predetermined breaking points in, for example, the barrier film by, for example, laser ablation can be dispensed with since very large forces can be safely exerted on the barrier film or the sealing film by the punch unit 120. An associated additional production step is not required. Through the use of the mechanically actuated punch unit 120, it is possible to use for example barrier films which have a strong layer structure and/or are formed to be very thick, for example by PP and metal layers, in particular aluminum, these can nevertheless be reliably broken open.

This also promotes storage of the fluid 205 in a long-term stable state.

Advantageously, the punch unit 120 does not come into contact with the pre-stored fluid 205 during the entire release process. The flexible diaphragm 135 allows complete separation of the mechanical actuating mechanism, in the form of the punch unit 120, and the fluid 125 in the fluid chamber 110. The punch unit 120 can therefore be fixedly installed in an activation unit and does not have to be disposed of together with the blister, or the insert part in the form of the insert container, which is for example used. Consequently, both costs for the device 100 and costs for an activation unit remain low since this requires no additional mechanism in order to grip a punch unit 120 accommodated at the device 100.

According to this exemplary embodiment, the reagent storage concept is based on the chamber substrate 105 composed of a polymer substrate with an integrated fluid chamber 110 which is sealed by the barrier film. The chamber substrate 105 can consist of plastics with good barrier properties, for example PP, PE, COC and COP, or have additional coatings, such as Al, Al2O3 and SiO, which satisfy requirements for storage of fluids 205 such as liquid reagents in a long-term stable state. The chamber substrate 105 is connected to the flexible diaphragm 135 and to a further polymer substrate, the cover substrate 115. Laser transmission welding, ultrasound welding, thermal bonding, adhesive bonding, clamping or comparable processes are suitable as joining processes for this multilayer structure. The cover substrate 135 has at least one aperture in the form of the punch opening 125. For the release of the fluid 205, the punch unit 120 moves through the punch opening 125, deflects the flexible diaphragm 135 without tearing it, and breaks open the barrier film. In this case, the fluid 205 is displaced into the transfer chamber 210 via the transfer channel in the form of the channel 140, and is available for further microfluidic processes. For example, when opening the valve 215, the fluid 205 can be suctioned by a negative pressure in a microfluidic network situated therebehind. The flexible diaphragm 135 allows complete fluidic separation between the fluidics in the chamber substrate 105 with all fluids 205 involved and the mechanical punch unit 120. The punch unit 120 is in this case preferably formed such that it displaces the greatest possible volume from the fluid chamber 110 without providing such a sealing effect at the edges of the fluid chamber 110 that fluid 205 no longer passes into the transfer chamber 210. This can best be achieved when the shape of the punch unit 120 corresponds to the inverse of the fluid chamber 110, but has for example a tolerance of a few 100 μm on the outer walls.

According to an alternative exemplary embodiment, any desired geometries, dimensions and shapes which promote targeted tearing of the barrier film and/or the sealing film and directed emptying of the fluid chamber 110 are conceivable for the punch unit 120. For example, it is possible for the punch unit 120 to provide a recess, directed toward the transfer chamber 210, in order to promote the displacement of the fluid 205 into the transfer chamber 210. In this way, interference of the fluid 205 can be minimized.

Figure 5:
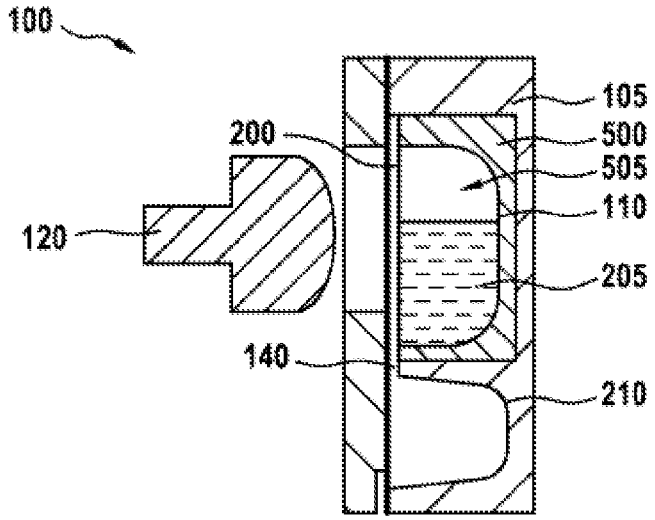
FIG. 5 shows a cross-sectional illustration of a microfluidic device with an insert container according to an exemplary embodiment.

FIG. 5 shows a schematic cross section of a microfluidic device 100 with an insert container 500 according to an exemplary embodiment. Here, this can be the device 100 described on the basis of FIG. 2, with the difference that, according to this exemplary embodiment, the insert container 500, which has a cavity 505, is accommodated by the fluid chamber 110. The fluid 205 is arranged in the cavity 505 of the insert container 500. According to this exemplary embodiment, the fluid chamber 110 has a cross section of rectangular form to hold the insert container 500 which, according to this exemplary embodiment, likewise has a rectangular cross section. The insert container 500 can be inserted into the fluid chamber 110 with an accurate fit or with an approximately accurate fit. As a result of the separate insert container, it is possible, in an advantageous and space-saving embodiment, to completely dispense with the channel 140 or the wall between the fluid chamber 110 and the transfer chamber 210. According to an exemplary embodiment, the fluid chamber 110 and the transfer chamber 210 are combined into one chamber or, expressed differently, the transfer chamber 210 and the insert container 500 (also referred to as "insert") are not separate. Alternatively, the wall between the fluid chamber 110 and the transfer chamber 210 can be reduced to a small indentation, can be formed as a web for holding the insert container 500 in the fluid chamber 110 or can have a through-opening which forms the channel 140.

In this further advantageous exemplary embodiment, the additional insert container 500 has been integrated into the chamber substrate 105. Ideally, the insert container 105 has better barrier properties than the surrounding chamber substrate 105. Said insert container 500 contains the fluid 205 and is sealed by the barrier film 200. The release of the fluid 205 is realized in a manner identical to that described in the previous figures. According to this exemplary embodiment, the material selection of the chamber substrate 105 remains independent of the requirements for the pre-storage of reagents in a long-term stable state.

The insert container 500 can be adhesively bonded, clamped, welded or integrated by other joining processes. The insert container 500 can also simply have been inserted into a suitably formed receiving chamber in the form of the fluid chamber 110 in the chamber substrate 105. Here, "suitably formed" means that the fluid chamber 110 tightly surrounds the insert container 500. This has the advantage that the dead volume of the structure is minimized, and slippage of the insert container 500 is avoided.

The insert container 500 has, according to this exemplary embodiment, the cavity 505 for accommodating the fluid 205 but can also have, according to an alternative exemplary embodiment, a plurality of such cavities 505 which, for example, are each filled with different fluids 205. Said cavities 505 can be arranged in the form of a beam or also can be connected to one another only at particular positions, for example on the top side, in a comb-like manner. This has the advantage that, in the fluid chamber 110, separating elements, for example walls, can be arranged between the different fluids 205, which are able to reliably prevent mixing of the fluids 205. Furthermore, the deflection of the flexible diaphragm 135 by the movable punch unit leads to the sealing of the fluidic path at the connection cutouts 605 illustrated in FIG. 6 in order to be able to reliably prevent mixing of the fluids 205, stored in separate fluid chambers 110, after their release.

Figure 6:
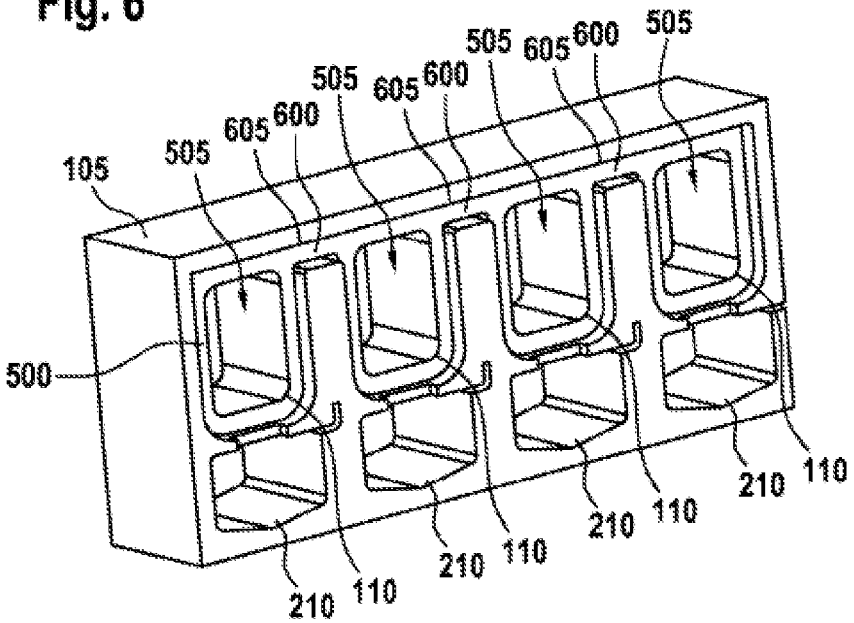
FIG. 6 shows a perspective view of a chamber substrate with a plurality of fluid chambers according to an exemplary embodiment.

FIG. 6 shows a perspective illustration of a chamber substrate 105 with a plurality of fluid chambers 110 according to an exemplary embodiment. Here, this can be the chamber substrate 105 described on the basis of FIG. 5, with the difference that no fluid is accommodated in the cavities 505 of the insert container 500. According to this exemplary embodiment, the chamber substrate 105 has four fluid chambers 110 which are arranged next to one another. The number of the fluid chambers 110 is merely an example, and so it is also possible for more than or fewer than four fluid chambers 110 to be provided. According to this exemplary embodiment, four transfer chambers 110 are arranged beneath the fluid chambers 210. According to this exemplary embodiment, the fluid chambers 110 have the insert container 500, wherein, according to this exemplary embodiment, the insert container 500 is formed as an insert container 500 comprising four cavities, with one of the cavities 505 in each case being accommodated in one of the four fluid chambers 110. According to this exemplary embodiment, the insert container 500 has three connection webs 600 between the cavities 505 in a region facing away from the transfer chambers 210. The chamber substrate 105 has, corresponding to the connection webs 600, three connection cutouts 605, for receiving the connection webs 600, in the region.

Figure 7:
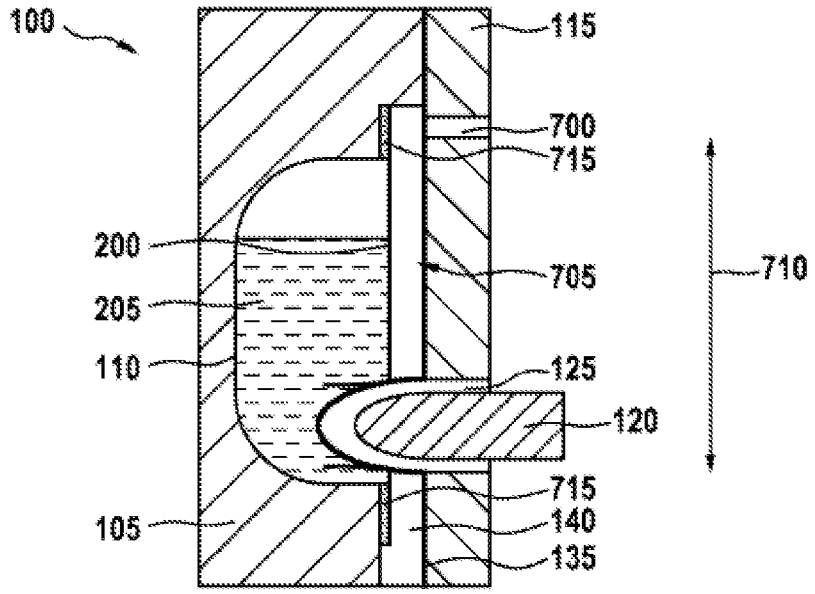
FIG. 7 shows a cross-sectional illustration of a microfluidic device with a venting opening according to an exemplary embodiment.

FIG. 7 shows a cross section of a microfluidic device 100 with a venting opening 700 according to an exemplary embodiment. Here, this can be the device 100 described on the basis of FIG. 3, with the difference that the punch opening 125 is formed so as to be smaller than in FIG. 3 and is arranged in the region of the channel 140, and that the channel 140 has a channel extension 705 which has the venting opening 700. According to this exemplary embodiment, the channel extension 705 extends in a direction facing away from the channel 140, the punch opening 125 being arranged in this case between the channel extension 705 and the channel 140. Moreover, the channel extension 705 is arranged between the fluid chamber 110 and the diaphragm 135. According to this exemplary embodiment, the channel extension 705 extends beyond a height 710 of the fluid chamber 110, wherein the venting opening 700 opens, transversely with respect to the channel extension 705, into an end of the channel extension 705 which is arranged outside the height 710. According to this exemplary embodiment, the venting opening 700 extends parallel to the punch opening 125 on a side of the fluid chamber 110 facing away from the punch opening 100.

According to this exemplary embodiment, a blister is embedded into the chamber substrate 105 such that two sealed sealing regions 715 of the blister bear on a surface, provided for this purpose, in the chamber substrate 105 and, for example, are able to be adhesively bonded there. The cover substrate 115 has the venting opening 700, under which the diaphragm 135 is open.

The punch opening 125 is closed by the diaphragm 135. The punch unit 120 can penetrate into the subassembly in the form of the device 100 through the punch opening 125 and pierce the barrier film 200 and the sealing film which surrounds the blister. The fluid 205 can then be emptied through the channel 140. This exemplary embodiment has the advantage in particular that an additional supply chamber in the form of the transfer chamber can be dispensed with. This exemplary embodiment thus permits a particularly space-saving possibility for the pre-storage of the fluid 205.

Figure 8:
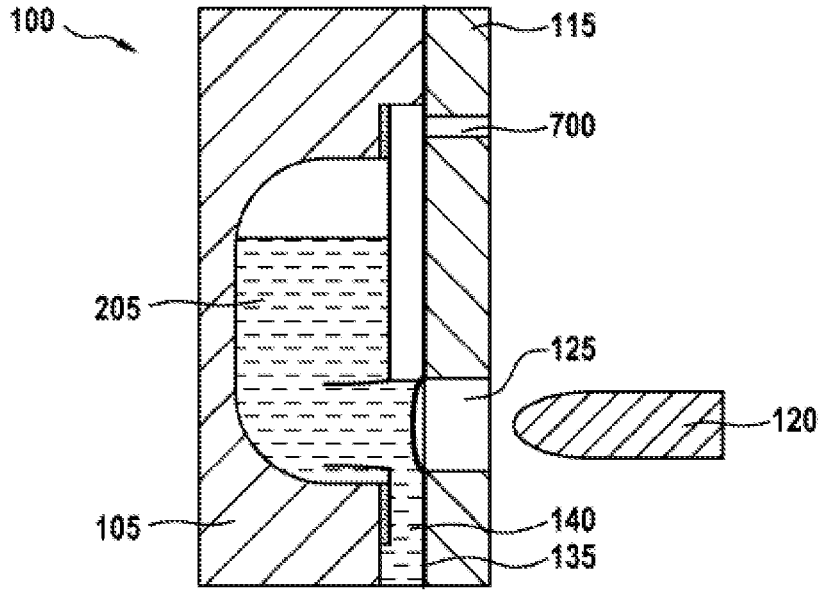
FIG. 8 shows a cross-sectional illustration of a microfluidic device with a venting opening according to an exemplary embodiment.

FIG. 8 shows a cross section of a microfluidic device 100 with a venting opening 700 according to an exemplary embodiment. Here, this can be the device 100 described on the basis of FIG. 7, with the difference that, according to this exemplary embodiment, the punch unit 120 has been guided back out of the device 100, as a result of which the diaphragm 135 has retracted in the region of the punch opening 125 and the fluid 205 flows into the channel 140.

Figure 9:
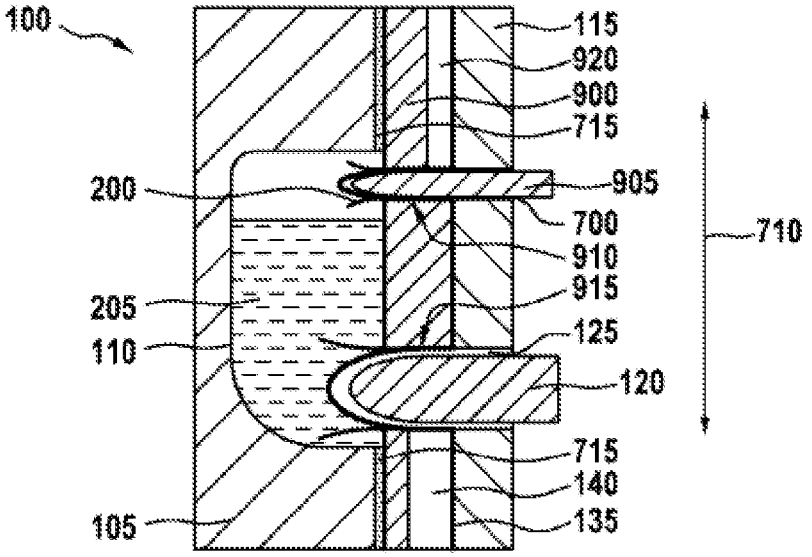
FIG. 9 shows a cross-sectional illustration of a microfluidic device with an intermediate substrate and with a further punch device according to an exemplary embodiment.

FIG. 9 shows a cross section of a microfluidic device 100 with an intermediate substrate 900 and with a further punch unit 905 according to an exemplary embodiment. Here, this can be the device 100 described on the basis of FIG. 7, with the difference that the channel 140 has no channel extension and the venting opening 700 is arranged in a region of the height 710. The intermediate substrate 900 is arranged between the chamber substrate 105 and the cover substrate 115. The intermediate substrate 900 has a further venting opening 910 and a further punch opening 915.

The further punch opening 915 extends the punch opening 125, and the further venting opening 910 extends the venting opening 700. The intermediate substrate 900 is formed to form an air channel 920 opening into the further venting channel 910. The air channel 920 is arranged transversely with respect to the further venting channel 910 on a side of the diaphragm 135 facing the fluid chamber 110. The air channel 920 extends in a direction facing away from the punch opening 125. According to this exemplary embodiment, the further punch unit 905 has been inserted into the fluid chamber 110 through the venting opening 700 and the further venting opening 910. According to this exemplary embodiment, the further punch unit 905 opens the barrier film 200 and/or the sealing film of the blister, which is accommodated for example, in a region in which the fluid 205 is not arranged in the case of the position shown in FIG. 9. According to this exemplary embodiment, the two sealing regions 715 are arranged between the chamber substrate 105 and the intermediate substrate 900. According to this exemplary embodiment, use is made of a second ram in the form of the further punch unit 905 in order to push a second opening into the barrier film 200 and/or the sealing film of a blister. Since blisters are not completely filled owing to their production, it is particularly advantageous to make the second opening at a position of the stick pack, that is to say of the blister, behind which position air or gas is situated. This exemplary embodiment has the advantage in particular that the blister can be vented via the air channel 920 and thus particularly high emptying efficiency is achieved.

In an alternative exemplary embodiment, the fluid 205 is pre-stored directly in the fluid chamber 110 which is sealed by the barrier film 200. In this case, the arrangement has been selected such that the barrier film 200 is connected in an areal manner to the chamber substrate 105 in the sealing regions 715. For the purpose of releasing the fluid, the two mechanical punch units 120, 905 are moved into the provided apertures in the form of the punch opening 125 and the venting opening 700 in the cover substrate 115 and the further punch opening 915 and the further venting opening 910 in the intermediate substrate 900 and deflect the flexible diaphragm 135. In this case, the barrier film 200 is broken open in the region of the further punch opening 915 and the further venting opening 910. Moving the punch devices 120, 905 back again results in the venting path in the form of the air channel 920 and the fluidic path in the form of the channel 140 being opened up.

A, for example, polymeric sealing layer of the barrier film 200 has the advantage in particular that the mechanical deformation is maintained after the mechanical punch devices 120, 905 have been moved back, and this ensures the blockage-free opening of the channel 140 and the pneumatic air channel 920. It is also particularly advantageous to design the further punch unit 905 such that this passes through the barrier film 200 before the punch unit 120. In this way, it is ensured that a positive pressure within the fluid chamber 110 which possibly arises can escape before the punch unit 120 enters. In the case of a different design of the punch units 120, 905, it is furthermore possible for simultaneous actuation to be realized.

Figure 10:
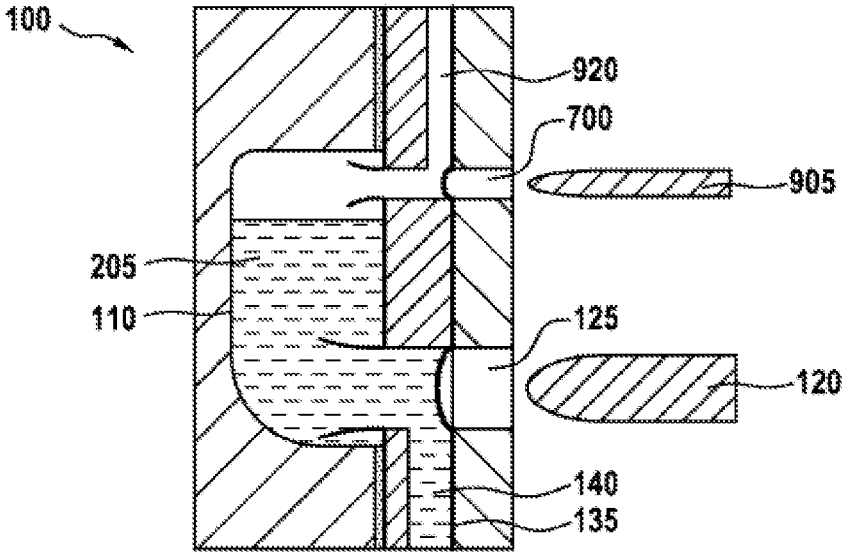
FIG. 10 shows a cross-sectional illustration of a microfluidic device with an intermediate substrate and with a further punch device according to an exemplary embodiment.

FIG. 10 shows a cross section of a microfluidic device 100 with an intermediate substrate 900 and with a further punch unit 905 according to an exemplary embodiment. Here, this can be the device 100 described on the basis of FIG. 9, with the difference that, according to this exemplary embodiment, the punch device 120 and the further punch device 905 have been guided back out of the device 100, as a result of which the diaphragm 135 has retracted in the region of the punch opening 125 and in the region of the venting opening 700, with the result that the fluid 205 flows into the channel 140 and a further fluid from the surroundings of the device 100 flows into the fluid chamber 110 through the air channel 920. This embodiment has the advantage in particular that the reagent can be actively suctioned through the channel 140 after the barrier film has been torn open and the punch units have moved back, wherein at the same time the risk of the formation of an air path up to the vent 700 (as in FIG. 7 and FIG. 8) is reduced to a minimum. The formation of an air path to the vent 700 would, in the most unfavorable case, result in active suctioning of the released reagent no longer being possible.

Figure 11:
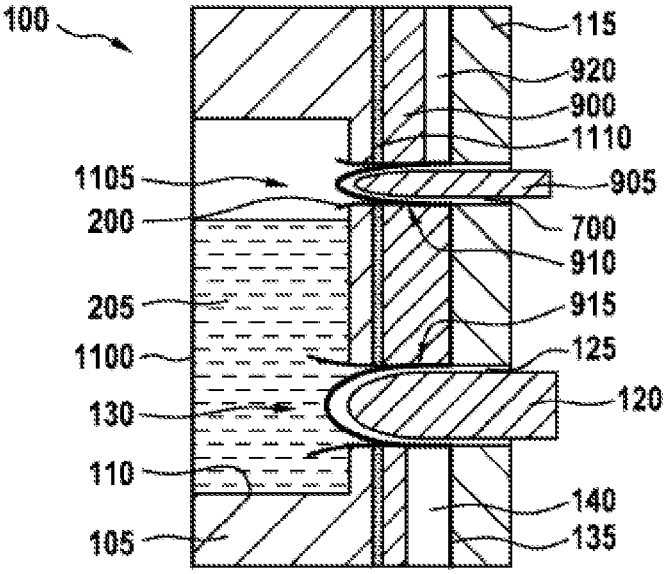
FIG. 11 shows a cross-sectional illustration of a microfluidic device with a further barrier film according to an exemplary embodiment.

FIG. 11 shows a cross section of a microfluidic device 100 with a further barrier film 1100 according to an exemplary embodiment. Here, this can be the device 100 described on the basis of FIG. 9, with the difference that the fluid chamber base is formed by the further barrier film 1100, and in that the fluid chamber 110 has a second punch opening 1105. According to this exemplary embodiment, the fluid chamber opening 130 has a diameter which corresponds to the punch opening 125. The fluid chamber opening 130 is arranged on a side of the fluid chamber 110 facing the channel 140. The second fluid chamber opening 1105 has a diameter which corresponds to the venting opening 700. The second fluid chamber opening 1105 is fluidically connected to the further venting opening 910. According to this exemplary embodiment, the fluid chamber 110 has a rectangular cross section. According to this exemplary embodiment, the chamber substrate 105 extends beyond the punch opening side comprising the fluid chamber opening 130 and the second punch opening 1105. According to this exemplary embodiment, the barrier film 200 is arranged between the chamber substrate 105 and the intermediate substrate 900, with the barrier film 200 spanning the fluid chamber opening 130 and the second punch opening 1105. According to this exemplary embodiment, the barrier film 200 has been opened in the region of the fluid chamber opening 130 and in the region of the second fluid chamber opening 1105 by the punch unit 120 and the further punch unit 905.

Details which have already been stated will be described more precisely below on the basis of FIG. 11:

According to this exemplary embodiment, the chamber substrate 105 is sealed on both sides with the barrier films 200, 1100. The chamber substrate 105, sealed on both sides, with integrated fluid 205 is attached via a joining step, for example by adhesive bonding and/or welding and/or clamping, to the multilayer structure of the device 100 such that the punch opening 125 and the venting opening 700 lie on an axis with the apertures in the form of the fluid chamber opening 130 and the second fluid chamber opening 1105. This has the advantage in particular that, when releasing fluid, the mechanical punch units 120, 905 break open the barrier film 200 in a defined manner, wherein no air path is able to form between the channel 140 and the air channel 920 since, in the remaining region, the chamber substrate 105 is connected in an air-tight manner to the intermediate substrate 900 via a planar joining surface 1100.

For the release of the fluid 205, the mechanical punch devices 120, 905 can be moved back and the fluid 205 which is present can for example be actively drawn in the fluidic channel 140. The advantage arises that, when the punch devices 120, 905 are pushed in, the further barrier film 200 limits the rise in pressure within the fluid chamber 110 by bulging outward slightly. Consequently, the risk of leaks during the opening is reduced.

Figure 12:
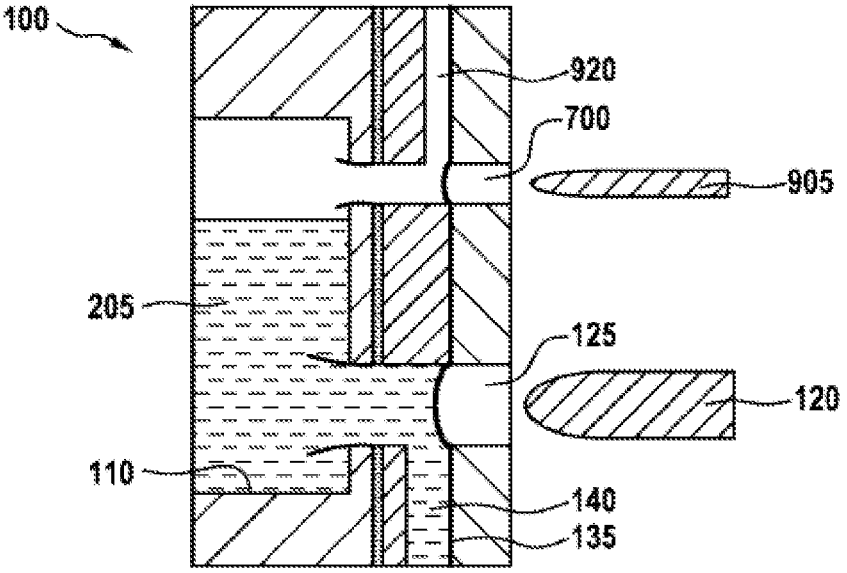
FIG. 12 shows a cross-sectional illustration of a microfluidic device with a further barrier film according to an exemplary embodiment.

FIG. 12 shows a cross section of a microfluidic device 100 with the further barrier film 1100 according to an exemplary embodiment. Here, this can be the device 100 described on the basis of FIG. 11, with the difference that, according to this exemplary embodiment, the punch device 120 and the further punch device 905 have been guided back out of the device 100, as a result of which the diaphragm 135 has retracted in the region of the punch opening 125 and in the region of the venting opening 700, with the result that the fluid 205 flows into the channel 140 and the further fluid from the surroundings of the device 100 flows into the fluid chamber 110 through the air channel 920.

Figure 13:
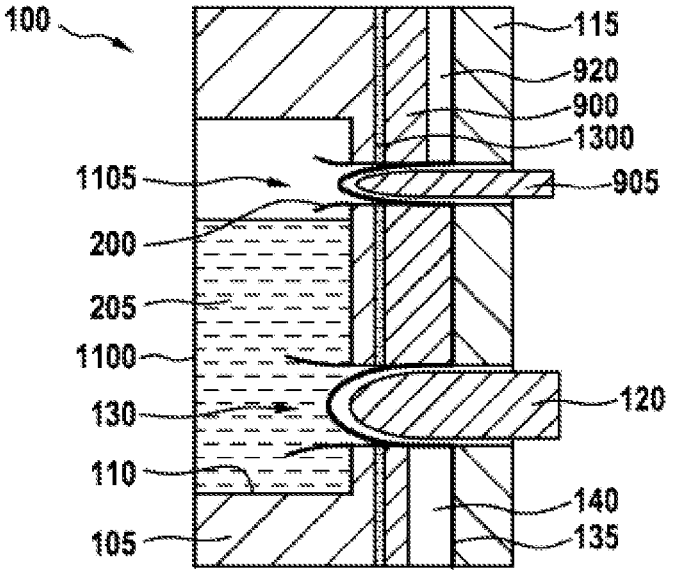
FIG. 13 shows a cross-sectional illustration of a microfluidic device with a further barrier film according to an exemplary embodiment.

FIG. 13 shows a cross section of a microfluidic device 100 with the further barrier film 1100 according to an exemplary embodiment. Here, this can be the device 100 described on the basis of FIG. 11, with the difference that, according to this exemplary embodiment, the barrier film 200 is arranged on an inner side of the fluid chamber 110 such that it spans the fluid chamber opening 130 and the second fluid chamber opening 1105. According to this exemplary embodiment, the barrier film 200 has been opened by the punch unit 120 and the further punch unit 905.

According to this exemplary embodiment, the barrier film 200 is sealed on the inner side of the fluid chamber 110, and so here too no air path is able to form between the channel 140 and the air channel 920. The chamber substrate 105 is connected via the joining surface 1110 in a form- or force-fitting manner directly to the multilayer structure of the device 100, that is to say to the intermediate substrate 900, for example by adhesive bonding and/or welding and/or clamping. According to an alternative exemplary embodiment, the barrier film 200 can be locally recessed in the chamber substrate 105 in the region of the fluid chamber opening 130 and the second fluid chamber opening 1105.

The required polymer substrates, that is to say the starting material, and the required structures in the polymer substrates can be created for example by milling, injection molding, hot stamping, deep drawing and/or laser structuring.

There follow examples of materials for the individual components of the devices 100 described on the basis of the previous figures.

Materials for the chamber substrate 105 and the cover substrate 115 can be thermoplastics, for example PC, PA, PS, PP, PE, PMMA, COP or COC.

Materials for the insert container 500 can be thermoplastics, for example PC, PA, PS, PP, PE, PMMA, COP or COC, and/or glass.

Materials for the punch device 120 and the further punch device 905 can be thermoplastics, for example PC, PA, PS, PP, PE, PMMA, COP or COC, and/or metals, such as steel or brass, and elastomers.

Coatings of reservoirs, such as for example the fluid chamber 110, can be carried out using Al, $Al_2O_3$ or $SiO_2$.

Materials for the diaphragm 135 can be elastomers, thermoplastic elastomers (TPU, TPS), thermoplastics or hot-bonding films.

As the barrier film 200 and sealing film, commercially available polymer composite films composed of polymer sealing and protection layers, for example PE, PP, PA or PET, can be used, and as the barrier layer, generally vapor-deposited aluminum but also other high barrier layers, such as EVOH, BOPP, can be used.

There follow examples of dimensions of elements of the exemplary embodiments:

The thickness of the chamber substrate 105 and the cover substrate 115 can be 0.5 to 5 mm. The thickness of the diaphragm 135 can be 5 to 300 μm. In the case of a multilayer structure of the barrier films 200, a thickness of the barrier layer (generally aluminum) can be 5 μm to 500 μm, a thickness of the polymer layer can be 5 μm to 500 μm, a thickness of the protection layer can be 5 μm to 500 μm and an elastic layer on the sealing film can be 50 μm to 2 mm.

The volume of the blister can be 100 to 10 000 μl.

Cuboidal shapes, cylinder shapes, cubic shapes and any other desired suitable shapes and geometries can be used as shapes for the punch devices 120, 905.

Figure 14:
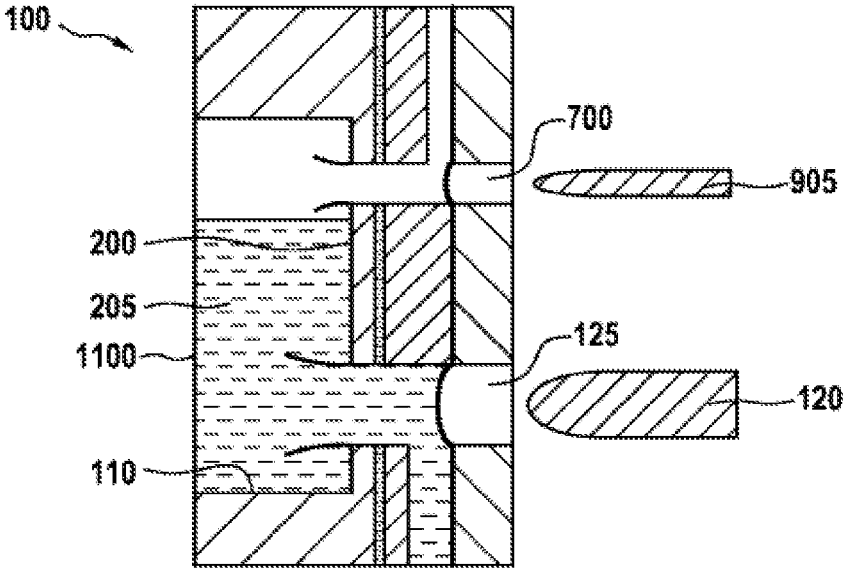
FIG. 14 shows a cross-sectional illustration of a microfluidic device with a further barrier film according to an exemplary embodiment.

FIG. 14 shows a cross section of a microfluidic device 100 with the further barrier film 1100 according to an exemplary embodiment. Here, this can be the device 100 described on the basis of FIG. 12, with the difference that, according to this exemplary embodiment, the barrier film 200 is arranged on the inner side of the fluid chamber 110.

Figure 15:
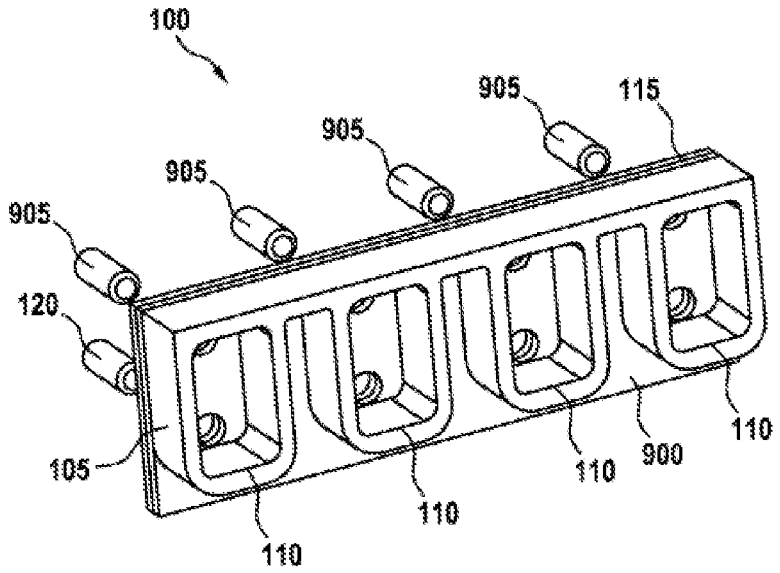
FIG. 15 shows a perspective illustration of a device with a plurality of fluid chambers according to an exemplary embodiment.

FIG. 15 shows a perspective illustration of a device 100 with a plurality of fluid chambers 110 according to an exemplary embodiment. Here, this can be one of the devices 100 described on the basis of FIGS. 11 to 14. According to this exemplary embodiment, the chamber substrate 105 has four fluid chambers 110 arranged adjacent to one another.

Figure 16:
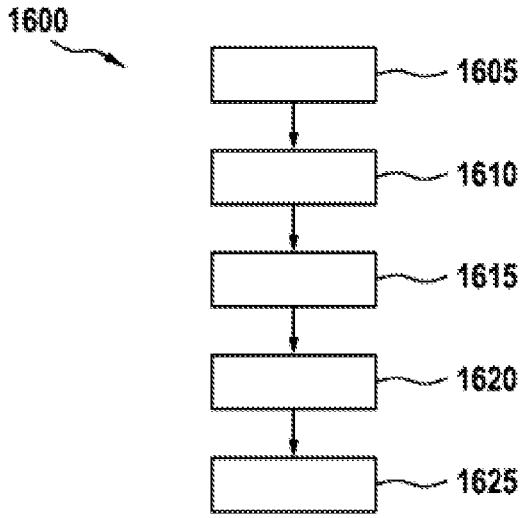
FIG. 16 shows a flow diagram of a method for producing a microfluidic device according to an exemplary embodiment.

FIG. 16 shows a flow diagram of a method 1600 for producing a microfluidic device according to an exemplary embodiment. Here, this can be one of the devices described on the basis of FIGS. 1 to 5.

In a step of provision 1605, a chamber substrate with a fluid chamber for accommodating a fluid is provided. In a further step of provision 1610, a cover substrate with a punch opening arranged opposite a fluid chamber opening of the fluid chamber is added. In a step of arrangement 1615, a flexible diaphragm is arranged between the chamber substrate and the cover substrate, wherein the diaphragm spans the punch opening and the fluid chamber. In a further step of creation 1620, a channel which extends on a side of the diaphragm facing the chamber substrate is created, said channel being fluidically connected to the fluid chamber. The step of creation 1620 can be carried out at a suitable point in time during the method, for example also before the step of provision 1610 of the cover substrate so that the cover substrate having the channel can be provided already during the step of provision 1610. In a step of arrangement 1625, there is arranged a punch unit which is designed to move into the fluid chamber through the punch opening in order to deflect the diaphragm into the fluid chamber in order to allow the fluid to flow out of the fluid chamber into the channel when the fluid is accommodated in the fluid chamber.

Figure 17:
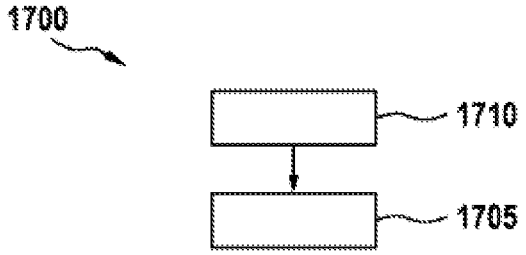
FIG. 17 shows a flow diagram of a method for operating a microfluidic device according to an exemplary embodiment.

FIG. 17 shows a flow diagram of a method 1700 for operating a microfluidic device according to an exemplary embodiment. Here, this can be one of the devices described on the basis of FIGS. 1 to 5.

In a step of moving-in 1705, a punch unit is moved into the fluid chamber through the punch opening in order to deflect the diaphragm into the fluid chamber in order to allow the fluid to flow out of the fluid chamber into the channel when the fluid is accommodated in the fluid chamber. According to an exemplary embodiment, the force is applied by a punch unit, which is actuated in an optional step 1710. The actuation can be realized for example through the use of a mechanical or electromechanical actuation device.

If an exemplary embodiment comprises an "and/or" conjunction between a first feature and a second feature, this should be read to mean that, according to one embodiment, the exemplary embodiment comprises both the first feature and the second feature and, according to a further embodiment, the exemplary embodiment comprises either only the first feature or only the second feature.

The invention claimed is:

1. A microfluidic device comprising:

a chamber substrate including a fluid chamber configured to receive a fluid, the fluid chamber having a fluid chamber opening;

a cover substrate including a punch opening positioned opposite the fluid chamber opening of the fluid chamber;

a flexible diaphragm positioned between the chamber substrate and the cover substrate, the flexible diaphragm spanning the punch opening and the fluid chamber;

a punch unit configured to move into the fluid chamber through the punch opening in order to deflect the diaphragm into the fluid chamber so as to enable the fluid to flow out of the fluid chamber when the fluid is received in the fluid chamber; and a channel extending on a side of the flexible diaphragm facing the chamber substrate and fluidically connected to the fluid chamber, wherein the channel includes a channel extension, wherein the cover substrate further includes a venting opening that opens into the channel extension, wherein the punch opening is positioned between the venting opening and the channel, and wherein the flexible diaphragm does not span the venting opening.

2. The microfluidic device as claimed in claim 1, further comprising:

a barrier film that closes off the fluid chamber, and that is configured to keep the fluid in the fluid chamber;

wherein the barrier film is configured to open in response to engagement with the punch unit.

3. The microfluidic device according to claim 2, wherein:

the fluid chamber includes an insert container;

the fluid is received in the insert container; and the barrier film closes off the insert container.

4. The microfluidic device according to claim 1, wherein the fluid chamber includes a blister that substantially fills a volume of the fluid chamber, and that is configured to open in response to engagement with the punch unit.

5. The microfluidic device as claimed in claim 1, wherein a diameter of the punch opening is greater than half of a diameter of the fluid chamber opening.

6. The microfluidic device as claimed in claim 1, wherein:

a diameter of the punch opening is less than half of a diameter of the fluid chamber opening; and the punch opening is at a location adjacent to the channel.

7. The microfluidic device as claimed in claim 6, further comprising:

a further punch unit, wherein:

the cover substrate further includes a venting opening that opens into the fluid chamber;

the punch opening is located between the venting opening and the channel;

the flexible diaphragm spans the venting opening; and the further punch unit is configured to move into the fluid chamber through the venting opening in order to deflect the flexible diaphragm into the fluid chamber so as to enable a further fluid to flow into the fluid chamber.

8. The microfluidic device as claimed in claim 7, further comprising an intermediate substrate positioned between the chamber substrate and the flexible diaphragm, the intermediate substrate including:

a further punch opening that extends the punch opening; and a further venting opening that extends the venting opening;

wherein the intermediate substrate is configured to form an air channel extending transversely with respect to the venting opening and opening into the further venting opening.

9. The microfluidic device as claimed in claim 8, wherein the channel extends between the flexible diaphragm and the intermediate substrate and opens into the punch opening.

10. The microfluidic device as claimed in claim 8, wherein:

a diameter of the fluid chamber opening corresponds to a diameter of the punch opening; and the fluid chamber further has a second fluid chamber opening with a diameter that corresponds to a diameter of the further venting opening.

11. The microfluidic device as claimed in claim 8, further comprising a further barrier film that forms a fluid chamber base opposite the fluid chamber opening.

12. A method for producing a microfluidic device, comprising:

arranging (i) a chamber substrate having a fluid chamber configured to receive a fluid and having a fluid opening, (ii) a cover substrate having a punch opening, and (iii) a flexible diaphragm such that the punch opening of the cove substrate is opposite the fluid chamber opening of the fluid chamber, such that the flexible diaphragm is positioned between the chamber substrate and cover substrate, and such that the flexible diaphragm spans the punch opening and the fluid chamber opening; and arranging a punch unit such that the punch unit is configured to move into the fluid chamber through the punch opening in order to deflect the diaphragm into the fluid chamber so as to enable the fluid to flow out of the fluid chamber when the fluid is received in the fluid chamber, wherein a channel extends on a side of the flexible diaphragm facing the chamber substrate and fluidically connected to the fluid chamber, wherein the channel includes a channel extension, wherein the cover substrate further includes a venting opening that opens into the channel extension, wherein the punch opening is positioned between the venting opening and the channel, and wherein the flexible diaphragm does not span the venting opening.

13. A method for operating the microfluidic device as claimed in claim 1, comprising:

moving the punch unit of the microfluidic device into the fluid chamber through the punch opening in order to deflect the diaphragm into the fluid chamber so as to enable the fluid to flow out of the fluid chamber when the fluid is accommodated in the fluid chamber.

14. A microfluidic device comprising:

a chamber substrate including a fluid chamber configured to receive a fluid, the fluid chamber having a fluid chamber opening;

a cover substrate including a punch opening positioned opposite the fluid chamber opening of the fluid chamber;

a flexible diaphragm positioned between the chamber substrate and the cover substrate, the flexible diaphragm spanning the punch opening and the fluid chamber;

a punch unit configured to move into the fluid chamber through the punch opening in order to deflect the diaphragm into the fluid chamber so as to enable the fluid to flow out of the fluid chamber when the fluid is received in the fluid chamber;

a channel extending on a side of the flexible diaphragm facing the chamber substrate and fluidically connected to the fluid chamber; and a further punch unit, wherein the cover substrate further includes a venting opening that opens into the fluid chamber, wherein the punch opening is located between the venting opening and the channel, wherein the flexible diaphragm spans the venting opening, and wherein the further punch unit is configured to move into the fluid chamber through the venting opening in order to deflect the flexible diaphragm into the fluid chamber so as to enable a further fluid to flow into the fluid chamber.

15. The microfluidic device as claimed in claim 14, further comprising an intermediate substrate positioned between the chamber substrate and the flexible diaphragm, the intermediate substrate including:

a further punch opening that extends the punch opening; and a further venting opening that extends the venting opening;

wherein the intermediate substrate is configured to form an air channel extending transversely with respect to the venting opening and opening into the further venting opening.

16. The microfluidic device as claimed in claim 15, wherein the channel extends between the flexible diaphragm and the intermediate substrate and opens into the punch opening.

17. The microfluidic device as claimed in claim 15, wherein:

a diameter of the fluid chamber opening corresponds to a diameter of the punch opening; and the fluid chamber further has a second fluid chamber opening with a diameter that corresponds to a diameter of the further venting opening.

18. The microfluidic device as claimed in claim 15, further comprising a further barrier film that forms a fluid chamber base opposite the fluid chamber opening.

* * * * *